US011551859B2

(12) United States Patent
Torii et al.

(10) Patent No.: US 11,551,859 B2
(45) Date of Patent: Jan. 10, 2023

(54) IGNITION COIL

(71) Applicant: DENSO CORPORATION, Kariya (JP)

(72) Inventors: Takehiro Torii, Kariya (JP); Junichi Wada, Kariya (JP)

(73) Assignee: DENSO CORPORATION, Kariya (JP)

( * ) Notice: Subject to any disclaimer, the term of this patent is extended or adjusted under 35 U.S.C. 154(b) by 181 days.

(21) Appl. No.: 17/158,333

(22) Filed: Jan. 26, 2021

(65) Prior Publication Data

US 2021/0233704 A1 Jul. 29, 2021

(30) Foreign Application Priority Data

Jan. 27, 2020 (JP) ..... JP2020-011018

(51) Int. Cl.
*H01F 38/12* (2006.01)
*H01F 27/26* (2006.01)
*H01F 27/28* (2006.01)

(52) U.S. Cl.
CPC ..... *H01F 38/12* (2013.01); *H01F 27/26* (2013.01); *H01F 27/28* (2013.01)

(58) Field of Classification Search
CPC ..... H01F 38/12; H01F 27/26; H01F 27/28; H01F 2038/127; H01F 27/00–40
See application file for complete search history.

(56) References Cited

U.S. PATENT DOCUMENTS 5,889,373 A * 3/1999 Fisher ..... H05B 41/2827 315/307
9,224,530 B2 * 12/2015 Kim ..... H01F 27/38

FOREIGN PATENT DOCUMENTS

JP 2006287089 A * 10/2006
JP 2009-290147 12/2009

* cited by examiner

*Primary Examiner* — Tuyen T Nguyen
(74) *Attorney, Agent, or Firm* — Nixon & Vanderhye P.C.

(57) ABSTRACT

An ignition coil has primary and secondary coils, a central core and a pair of split cores. One of the split cores has a first opposing face orthogonal to a coil axial direction X facing a core front end face of the central core in the coil axial direction X. The respective split cores have second opposing surfaces mutually facing each other in a lateral direction Y at a rear end of the central core. At least one of the second opposing surfaces and one of rear end surfaces of the central core contacting the least one of the second opposing surfaces collectively constitute a pair of oblique surfaces and come to close to the other one of the second opposing surfaces in the lateral direction Y as a portion of each of the oblique surfaces recedes further from the first opposing face in the coil axial direction X.

7 Claims, 9 Drawing Sheets

IGNITION COIL

CROSS-REFERENCE TO RELATED APPLICATION

This patent application is based on and claims priority to Japanese Patent Application No. 2020-011018, filed on Jan. 27, 2020 in the Japan Patent Office, the entire disclosure of which is hereby incorporated by reference herein.

BACKGROUND

Technical Field

The present disclosure relates to an ignition coil.

Related Art

A conventional ignition coil is sometimes composed of a central iron core inserted radially inside of each of primary and secondary coils. The ignition coil is further composed of a permanent magnet disposed facing a first end face of the central iron core. The ignition coil is further composed of an annular side iron core that surrounds the central iron core by partially facing both the first and second end faces of the central iron core along a winding axis extension direction around which the primary and secondary coils are wound.

More specifically, the annular iron core is composed of first and second side split iron cores respectively having cross sections of substantially L-shapes. The first and second side split iron cores are combined with each other thereby providing an annular shape as a whole. Furtherly, a section of the first side split iron core contacts a face of the permanent magnet opposite to another face of the permanent magnet facing the central iron core. By contrast, a section of the second side split iron core contacts the second end face of the central iron core, located opposite to the first end face facing the permanent magnet. These first and second side iron cores are coupled along an orthogonal direction orthogonal to the winding axis extension direction.

In such a situation, however, when a gap (i.e., space) is formed during assembly between one of the first side iron core portion and the permanent magnet or the second side iron core portion and the central iron core, performance of the ignition coil can be deteriorated.

Hence, in the above-described conventional ignition coil, to avoid the above-described problem, the first and second side iron cores have contact surfaces arranged parallel to the winding axis extension direction which contact each other. With this, when the first and second side iron cores are attached to the central iron core and the permanent magnet to assemble the first and second side iron cores, the central iron core and the permanent magnet into the ignition coil, the contact surfaces of the first and second side iron cores can be slid on each other to bring the first and second side iron cores to be close to each other in the coil axial direction after the contact surfaces of the first and second side iron cores are initially contacted with each other in the orthogonal direction. As a result, the first side iron core portion and the permanent magnet can be brought into contact with each other. At the same time, the second side iron core portion and the central iron core can be brought into contact with each other.

However, according to the above-described conventional ignition coil, as described above, when the first and second side iron cores are assembled into the ignition coil, these portions need to be pressed to approach each other both in the orthogonal direction and a winding axis extension direction at the same time. Hence, an assembly process of assembling the conventional ignition coil is likely to be complicated, thereby lowering productivity thereof.

Accordingly, it is an object of the present disclosure to address such a problem and to provide a novel ignition coil capable of improving productivity of the ignition coil.

SUMMARY

Accordingly, one aspect of the present disclosure provides a novel ignition coil that includes a primary coil and a secondary coil magnetically coupled to the primary coil. The secondary coil is coaxially wound radially outside of the primary coil. The ignition coil also includes a central core disposed radially inside of the primary coil with both ends projecting from both of the primary coil and the secondary coil in a coil axial direction X. The central core includes a central core front end face at a front end thereof facing forward in the coil axial direction. The central core also includes a pair of central core rear end oblique surfaces at a rear end thereof. The pair of central core rear end oblique surfaces is symmetrically inclined with a central axis of the central core. The ignition coil further includes a pair of split cores surrounding the primary coil and the secondary coil together with the central core. The pair of split cores respectively face outer peripheral portions of the secondary coil in an orthogonal direction orthogonal to the coil axial direction. The pair of split cores respectively form two closed magnetic paths with the central core. The ignition coil further includes at least one of the pair of the split cores having a first opposing face to face the central core front end face and partially form the closed magnetic path. The first opposing face is orthogonally extended to the coil axial direction. The pair of split cores respectively have two second oblique opposing surfaces which are symmetric with the central axis of the central core when attached thereto. The pair of split cores mutually face each other in the orthogonal direction while contacting the central core rear end oblique surfaces. At least one of the second oblique opposing surfaces and the central core rear end oblique surface contacting the at least one of second oblique opposing surfaces are inclined at substantially the same degree of angle from the central axis of the central core and increasingly approach the other one of the central core rear end surfaces in the orthogonal direction in proportion to a distance of a portion of each of the at least one of the second oblique opposing surfaces and the central core rear end oblique surface from the first opposing face of the at least one of the pair of the split cores in the coil axial direction.

In another aspect of the present disclosure provides a novel ignition coil with a magnetic plate attached to the central core front end face between the central core front end face and the first opposing face of one of the pair of split cores to enhance an output voltage output from the ignition coil. The central core, the magnet plate and the pair of split cores are mutually positioned during assembly of the ignition coil by pressure contacting and further pressing the pair of split cores against the central core in the orthogonal direction while sliding the at least one of the second oblique opposing surfaces and the central core rear end oblique surface on each other until the central core front end face contacts the first opposing face via the magnet plate.

Hence, according to both aspects of the present disclosure, the first opposing face is formed in the split core of the ignition coil parallel to a plane orthogonal to the coil axis. Besides, a portion of one of the second oblique opposing surfaces of the split core and that of the rear end oblique surface of the central core contacting the portion of one of the second oblique opposing surfaces of the split core increasingly approach the other one of the second oblique opposing surfaces of the split core in the orthogonal direction as the portions recede from the first opposing face in the coil axis extension direction. Hence, positioning between the central core and the pair of split cores can be precisely performed and facilitated, thereby enhancing productivity of the ignition coil.

BRIEF DESCRIPTION OF THE DRAWINGS

A more complete appreciation of the present disclosure and many of the attendant advantages of the present disclosure will be more readily obtained as substantially the same becomes better understood by reference to the following detailed description when considered in connection with the accompanying drawings, wherein.

DETAILED DESCRIPTION

Figure 1:
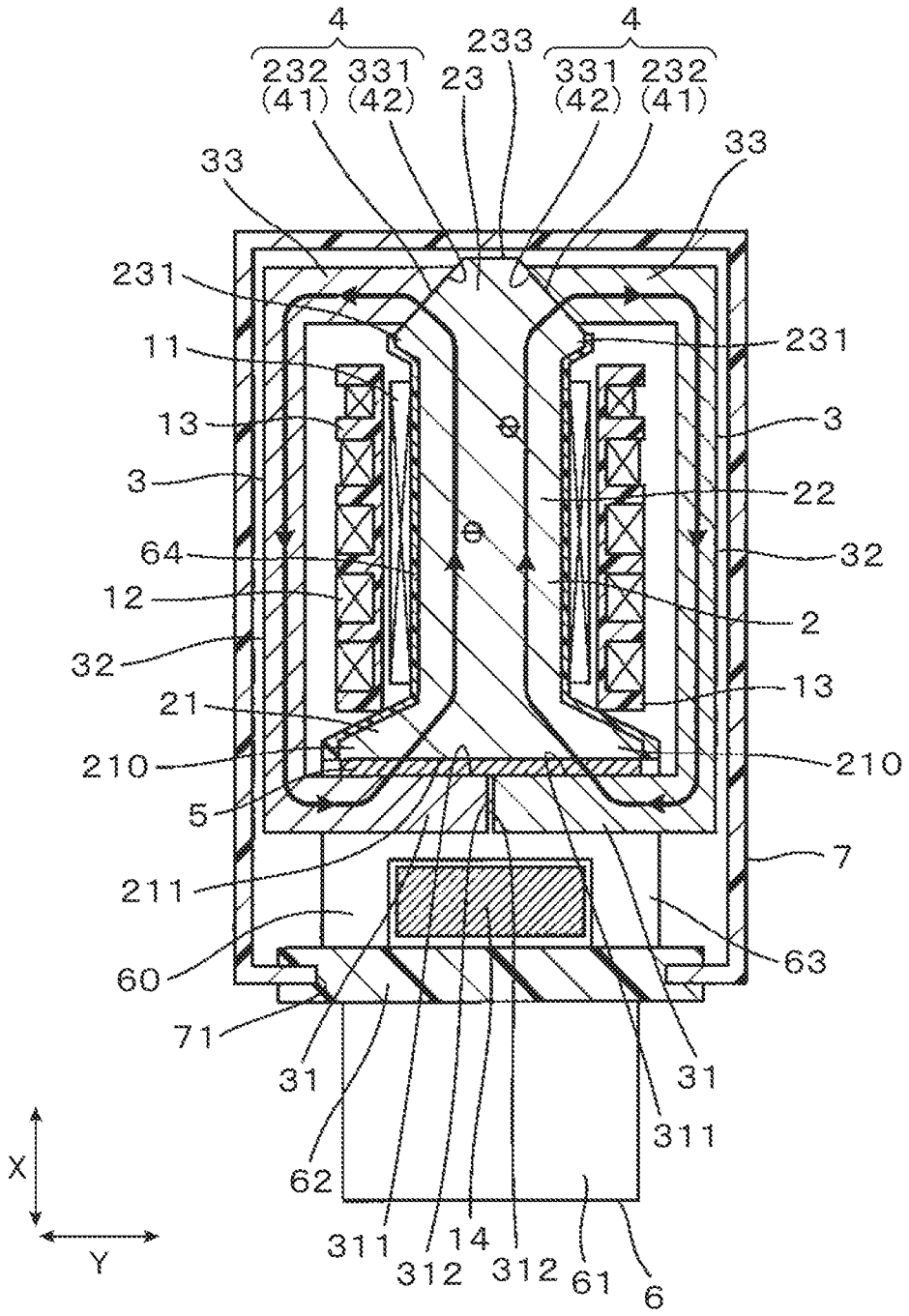
FIG. 1 is a vertical cross-sectional view illustrating an exemplary ignition coil according to a first embodiment of the present disclosure.

Referring now to the drawings, wherein like reference numerals designate identical or corresponding parts throughout the several views thereof, and to FIGS. 1 to 6, an ignition coil of a first embodiment of the present disclosure is described. As shown in FIG. 1, an ignition coil 1 of this embodiment includes a primary coil 11, a secondary coil 12 and a central core 2. The ignition coil 1 also includes a pair of split cores 3.

The primary coil 11 and the secondary coil 12 are magnetically coupled to each other. The central core 2 is disposed radially inside of the primary coil 11 and the secondary coil 12 with both ends in a coil axial direction X protruding from both of the primary coil 11 and the secondary coil 12. The split cores 3 of the pair are disposed facing respective outsides of the primary coil 11 and the secondary coil 12 in a lateral direction Y orthogonal to the coil axial direction X. The split cores 3 of the pair respectively form closed magnetic paths together with the central core 2.

At least one of the split cores 3 has a first opposing face 311 to face a first end face (hereafter referred to as a core front end face 211) of the central core 2 in the coil axial direction X. The central core 2 has a rear end 23 at a rear side of the central core 2 in the coil axial direction X. The split cores 3 respectively have second opposing surfaces 331 mutually facing each other at a rear end 23 of the central core 2 in the lateral direction Y.

Specifically, the first opposing face 311 is formed parallel to a virtual plane orthogonally extended to and from the coil axial direction X. The rear end 23 of the central core 2 has vertically symmetric rear tapered surfaces 232 respectively facing the second opposing surfaces 331. Hence, at least one of the second opposing surfaces 331 and corresponding one of the rear tapered surfaces 232 of the central core 2 facing the at least one of the second opposing surfaces 331 collectively constitute a first pair of oblique surfaces 4. Hence, the other one of the second opposing surfaces 331 and corresponding one of the rear tapered surfaces 232 of the central core 2 facing the other one of the second opposing surfaces 331 collectively constitute a second pair of oblique surfaces 4. Accordingly, these first and second pairs of oblique surfaces 4 are vertically symmetric. That is, the first pair of oblique surfaces 4 constituted by the second opposing face 331 and the rear tapered surface 232 approach the second pair of oblique surfaces 4 constituted by the other second opposing face 331 and the other rear tapered surface 232 in the lateral direction Y as the first pair of oblique surfaces 4 recede from the first opposing face 311 in the coil axial direction X. Hence, in this embodiment, each of the second opposing surfaces 331 constitutes the corresponding pair of oblique surfaces as described herein below in more detail.

Further, in this embodiment, the coil axial direction X is a direction in which a winding axis for the primary coil 11 and the secondary coil 12 extends, and is herein below referred to as a x-direction. Further, one side of the central core 2 facing the first opposing face 311 toward the x-direction is herein below referred to as a front side thereof. By contrast, an opposite side of the central core 2 is herein below referred to as a front end 21 thereof. However, these definitions of the front and rear sides are only used for the purpose of expedience, and do not limit, for example, orientation of the ignition coil 1 when it is mounted on a vehicle. Further, the aforementioned lateral direction Y is herein below referred to as a y-direction. Similarly, a direction orthogonal to both the x-direction and the y-direction is herein below referred to as a z-direction.

Further, an ignition coil 1 of this embodiment can be used in internal combustion engines, such as automobiles, cogenerations, etc., for example. Specifically, the ignition coil 1 is connected to a spark plug (not shown) installed in the internal combustion engine to act as a device for applying a high voltage to the spark plug.

Further, the central core 2 has a length extending in the x-direction. The central core 2 has a columnar portion 22 extended in the x-direction substantially at its lateral center.

The central core 2 also has a front end 21 and a rear end 23 at both sides of the columnar portion 22 in the x-direction, respectively.

Thus, the front end 21 is located at a front end of the central core 2 and further protrudes forward from both the primary coil 11 and the secondary coil 12. The front end 21 has a pair of vertically symmetric front flange portions 210 protruding from both left and right sides of the columnar portion 22 in the y-direction. That is, the front flange portions 210 collectively provide a given area to the core front end face 211 of the central core 2, thereby enabling placement of the magnet 5 having a wide cross-section extended orthogonal to the x-direction at the core front end face 211 as described later in more detail.

Further, the rear end 23 is formed at a rear end of the central core 2 and protrudes backward from each of the primary coil 11 and the secondary coil 12. The rear end 23 has a pair of rear vertically symmetric flange portions 231 protruding from both left and right sides of the columnar portion 22 in the y-direction. More specifically, each of the rear flange portions 231 protrudes in the y-direction from both left and right sides of the columnar portion 22 by a projection amount less than that each of the front flange portions 210 protrudes in the direction. More specifically, each of the flange portions 231 slightly protrudes by a projection amount less than that each of the front flange portions 210 protrudes, to stay axially inside of a secondary spool 13 described later in detail.

Further, the rear end 23 has rear tapered surfaces 232 on both left and right sides thereof in the y-direction, respectively, inclining to mutually approach each other as a portion of each of the rear tapered surfaces 232 recedes rearward. Specifically, the rear tapered surfaces 232 are extended toward the front end 21 hereof from protrusion ends of the rear flange portions 231, protruding in the y-direction. Further, respective rear edges of the rear tapered surfaces 232 are connected to each other via a connection surface 233 formed at the rear end of the central core 2. Further, when viewed in the z-direction, the connection surface 233 is formed not to protrude axially backward from virtual extension lines virtually extended respectively from the second opposing surfaces 331. With this, when the central core 2 and the split cores 3 are slid on each other in each of the oblique surfaces, the split cores 3 can be prevented from interfering with the connection surface 233 and freely slide thereon as described later more in detail. In this embodiment, the connection surface 233 has a plane orthogonally extended to the x-direction while facing backward.

Further, in front of the central core 2, the magnet 5 is disposed. The magnet 5 is composed of a rectangular plate having a prescribed thickness in the x-direction. The magnet 5 is disposed to face and contact the core front end face 211. A size of the magnet 5 is equivalent to that of the core front end face 211 when viewed in the x-direction, so that the magnet 5 can substantially completely cover the core front end face 211. The magnet 5 is employed to enhance an output voltage output from the ignition coil 1. That is, the magnet 5 applies a magnetic bias to the central core 2 to increase an amount of change in magnetic flux $\Phi$, thereby causing the secondary coil 12 to induce a higher voltage when the primary coil 11 is deenergized. Here, in proportion to a size of a cross-sectional area of it, the magnet 5 can apply a large magnetic bias to the central core 2.

Further, as shown in FIG. 1, the split cores 3 of the pair are disposed facing both left and right sides of each of the central core 2 and the magnet 5 to partially cover the central core 2 and the magnet 5. Each of the split cores 3 has substantially the same shape, but is disposed in line symmetry with respect to an axis of the central core 2. More specifically, each of the split cores 3 substantially has a U-shape with an opening mutually facing each other in the y-direction.

Further, each of the split core 3 forming the pair has a first side 31, a second side 32 and a third side 33 in this order from the front side thereof. Specifically, each of the first sides 31 is disposed in front of the magnet 5 and is extended in the y-direction. Further, the first sides 31 of the split cores 3 respectively have laterally opposing faces 312 to face each other in the y-direction. The laterally opposing faces 312 are located within a region substantially corresponding to a central region of the core front end face 211 when viewed in the y-direction. Here, the central region of the core front end face 211 in the y-direction can be defined as a central region among three regions when the core front end face 211 is equally divided into three in the y-direction, for example. That is, the central region of the core front end face 211 has a certain width in the y-direction near the center of the core front end face 211. Further, a little gap is formed between the laterally opposing faces 312 in the y-direction. However, the little gap can be omitted, and each of the pair of laterally opposing faces 312 can be in contact with each other.

Further, a surface of each of the first sides 31 facing rearwardly serves as a first opposing face 311 to face the core front end face 211 in the x-direction. Each of the first opposing faces 311 has a planar shape extended in a direction orthogonal to the x-direction. Each of the first opposing face 311 faces and contacts a front surface of the magnet 5.

Further, the second side 32 is extended rearwardly in the x-direction from an opposite end of the first side 31 opposite to the laterally opposing face 312. The second side 32 is disposed facing an outer side of each of the primary coil 11 and the secondary coil 12 to cover the primary coil 11 and the secondary coil 12. The second side 32 connects the first side 31 with the third side 33.

Further, the third side 33 is extended toward the rear end 23 of the central core 2 in the y-direction from a rear end 23 of the second side 32. As shown, an end face of each of the third sides 33, located at the rear end 23 of the central core 2 serves as a second opposing face 331 facing a rear tapered surface 232 of the central core 2.

As shown in FIG. 1, the second opposing surfaces 331 are symmetrically inclined to increasingly approach each other in the y-direction as portions of the second opposing surfaces 331 go rearward. The second opposing surfaces 331 directly contact the rear tapered surfaces 232 of the central core 2, respectively. Specifically, the second opposing face 331 and the rear tapered surface 232 facing the second opposing face 331 are substantially parallel to each other. Hence, the second opposing face 331 and the rear tapered surface 232 facing the second opposing face 331 collectively constitute a pair of oblique surfaces 4. That is, each of the second opposing face 331 and the rear tapered surface 232 is inclined to allow a portion of each of the second opposing face 331 and the rear tapered surface 232 to increasingly become distant from the corresponding second side 32 in the y-direction as the portion recedes rearward in the x-direction. For example, when viewed in the z-direction, each of the second opposing face 331 and the rear tapered surface 232 may be inclined by an angle of about 45 degrees from an axis extended in the x-direction. However, the angle is not limited thereto.

Further, as shown, among the pair of oblique surfaces 4, the rear tapered surface 232 provides a wider surface 41 wider than the second opposing face 331 providing a narrower surface 42 in an inclined direction of the pair of oblique surfaces 4. Further, a part of the rear tapered surface 232 is composed of a surface of the rear flange portion 231. That is, by forming the rear flange portion 231 in the central core 2 as a part of the rear tapered surface 232 and thereby extending the rear tapered surface 232 from the rear flange portion 231, the rear tapered surface 232 can be readily widened in the inclined direction. Further, the narrower surface 42 is located within a width of the wider surface 41 in the inclined direction not to extend beyond the wider surface 41 in the inclination direction.

Figure 2:
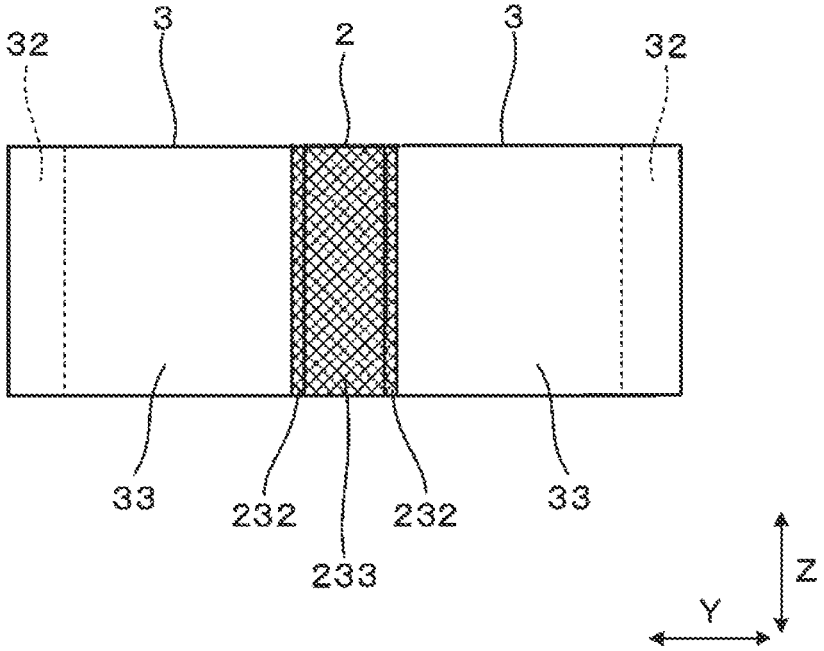
FIG. 2 is a plan view illustrating the exemplary ignition coil of FIG. 1 according to the first embodiment of the present disclosure.

Further, each of the central core 2 and the split cores 3 is produced, for example, by laminating plural electromagnetic steel sheets having a given thickness made of soft magnetic material in the z-direction. Further, as shown in FIG. 2, both ends of each of the split cores 3 is aligned with both ends of the central core 2 in the z-direction. As shown In FIG. 2, hatching is applied to the central core 2 for the purpose of convenience. However, each of the split cores 3 can protrude in the z-direction from the central core 2.

Further, as shown in FIG. 1, the central core 2 acts as a part of a connector module 6. The connector module 6 is integrally molded by using an insert molding process in which multiple terminals of the central core 2 and a connector 61 or the like are inserted into a mold and injecting insulation resin into the mold. Further, a primary spool 64 is provided in the connector module 6 around the central core 2. The primary coil 11 is wound around an outer periphery of the primary spool 64.

Further, as shown in FIG. 1, the connector module 6 includes a connector 61 at a front end thereof. The connector 61 is a connector for connecting the ignition coil 1 with an external device or the like. As shown, a fitting wall 62 is provided to fit into a housing 7 of the ignition coil 1. The connector 61 protrudes forward from the fitting wall 62 of the connector module 6. The fitting wall 62 and the primary spool 64 are connected to each other at a position facing a side of the magnet 5 along the z-direction via a connection wall 63.

Figure 3:
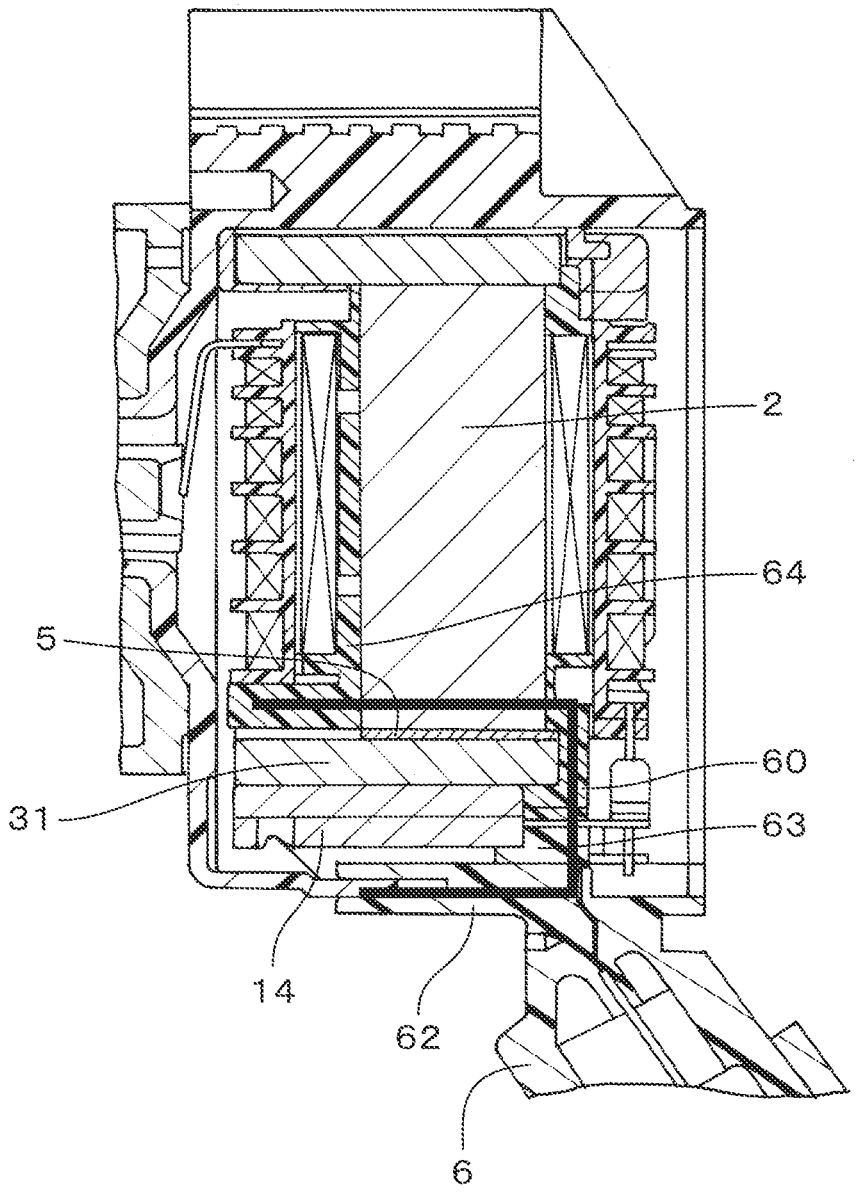
FIG. 3 is a vertical cross-sectional view illustrating an exemplary connector module parallel to an x-z plane according the first embodiment of the present disclosure.

Further, as shown in FIGS. 1 and 3, the connector module 6 has an arrangement recess 60 surrounded by the fitting wall 62, the connection wall 63, the primary spool 64 and the central core 2. The arrangement recess 60 is open to one side in the z-direction and both sides in the y-direction (see FIG. 3). Hence, the magnet 5, the first sides 31 of the split cores 3, and the igniter 14 are inserted into the arrangement recess 60 through an opening.

Further, in the arrangement recess 60, the igniter 14 is disposed in front of the first sides 31 of the split cores 3. The igniter 14 controls energizing and de-energizing of the primary coil 11. The igniter 14 is positioned overlapping with the laterally opposing faces 312 of the split cores 3 when viewed in the x-direction. Although it is not shown, the igniter 14 has a terminal protruding in the z-direction toward an opposite side to an opening side of the arrangement recess 60. Further, an opening is formed in the connection wall 63 to allow the terminal to pass it through.

Further, as shown in FIG. 1, a secondary spool 13 is disposed facing an outer circumference of the primary spool 64 to allow a secondary coil 12 to wind therearound. That is, the secondary coil 12 is wound around an outer circumference of the secondary spool 13. The secondary spool 13 is cylindrical and is made of resin or the like having electrical insulation. The secondary spool 13 is attached to the connector module 6 from the rear side of the primary spool 64 and is assembled. That is, since a minimum inner diameter of the secondary spool 13 is greater than a size of the rear end 23 of the central core 2, the secondary spool 13 can be attached from the rear side of the primary spool 64 when it is assembled.

Further, as shown in FIG. 1, various components constituting the ignition coil 1 are housed inside the housing 7 and the fitting wall 62 fitting into the housing 7. The housing 7 is made of resin having electrical insulation. An opposite side of the housing 7 opposite to the opening of the arrangement recess 60 in the z-direction is opened. A fitting recess 71 is formed in a front wall of the housing 7 to allow the fitting wall 62 to fit thereinto. The fitting recess 71 is formed by partially cutting away the front wall of the housing 7 from the open end of the housing 7 in the z-direction. Hence, the connector module 6 is attached to the housing 7 from the opening of the housing 7 with the fitting wall 62 of the connector module 6 fitting into the fitting recess 71.

Further, sealing resin is filled in a region surrounded by the housing 7 and the fitting wall 62. The sealing resin may be thermosetting resin which is electrically insulating, for example. Specifically, the sealing resin seals various components of the ignition coil 1 housed in an interior surrounded by the housing 7 and fitting wall 62. However, illustration of the sealing resin is omitted in the drawing.

Figure 4:
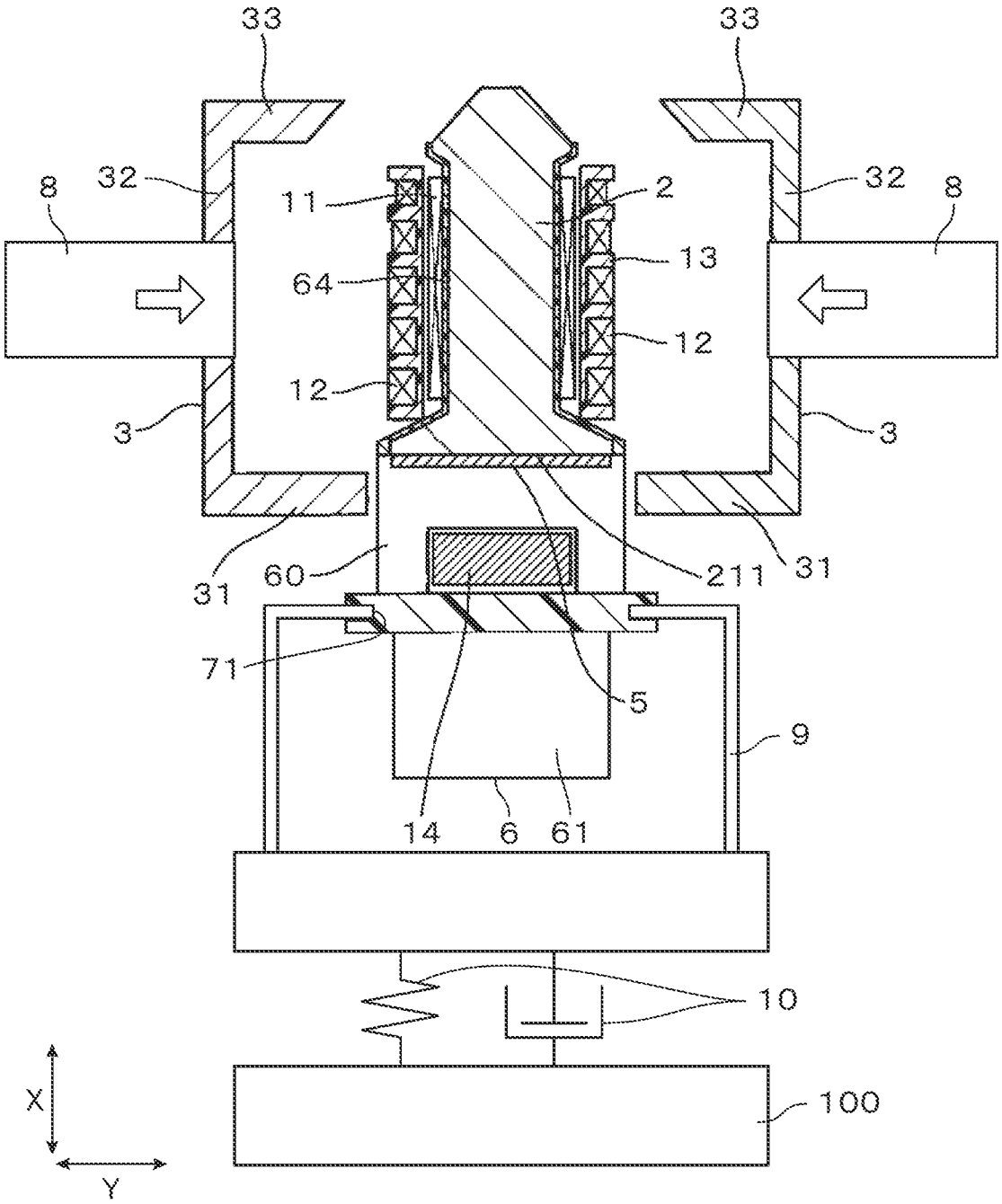
FIG. 4 is a vertical cross-sectional view illustrating an exemplary assembly system of assembling a pair of split cores and a connector module together into the ignition coil according the first embodiment of the present disclosure.
Figure 5:
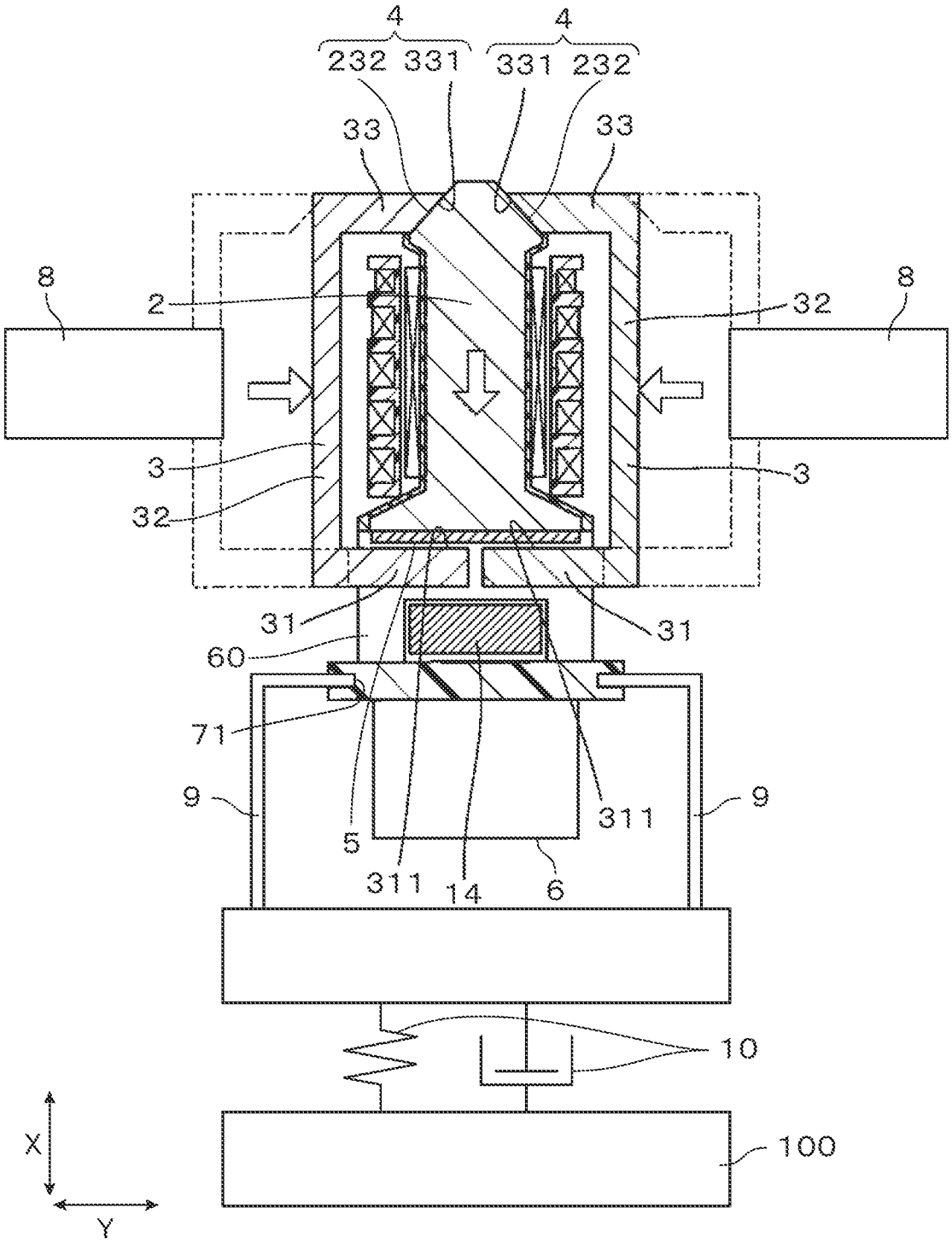
FIG. 5 is a vertical cross-sectional view illustrating the exemplary assembly system in a condition where the second opposing faces of the pair of split cores respectively contact the rear tapered surfaces of the central core during assembly of the ignition coil according the first embodiment of the present disclosure.

Further, as shown in FIGS. 4 and 5, left and right split core chucks 8 are disposed in an assembling system, respectively facing both sides of the connector module 6. The left and right split core chucks 8 are configured to simultaneously hold the pair of split cores 3 and approach and recede from the both sides of the connector module 6 in opposite y-directions to each other.

A connector chuck 9 is also disposed in the assembling system and is supported by a base 100 of the assembly system via an elastic member 10. The elastic member 10 can include a spring and/or a damper. The connector chuck 9 is configured to firmly hold the fitting recess 71 of the connector module 6.

Now, an exemplary method of assembling various components of the ignition coil 1 arranged in the housing 7 into the ignition coil 1 will be herein below described in detail with reference to FIGS. 4 to 6.

As shown in FIG. 4, the primary spool 64 of the connector module 6 with the primary coil 11 wound therearound is inserted into the secondary spool 13 with the secondary coil 12 wound therearound. Then, the igniter 14 is inserted into the arrangement recess 60. Subsequently, as shown in FIG. 3, a terminal of the igniter 14 is connected to a terminal disposed in the connector 61 by welding or the like.

Then, the magnet 5 is attached to the core front end face 211 of the central core 2 exposed from the connector module 6. With this, the magnet 5 and the core front end face 211 of the central core 2 are joined together by magnetic force of the magnet 5. Then, as shown in FIGS. 4 and 5, left and right split core chucks 8 hold the pair of split cores 3, and approach the both sides of the connector module 6 in the opposite y-directions to each other. At this moment, the connector chuck 9 supported by the base 100 of the assembly system via the elastic member 10 holds the fitting recess 71 of the connector module 6.

Figure 6:
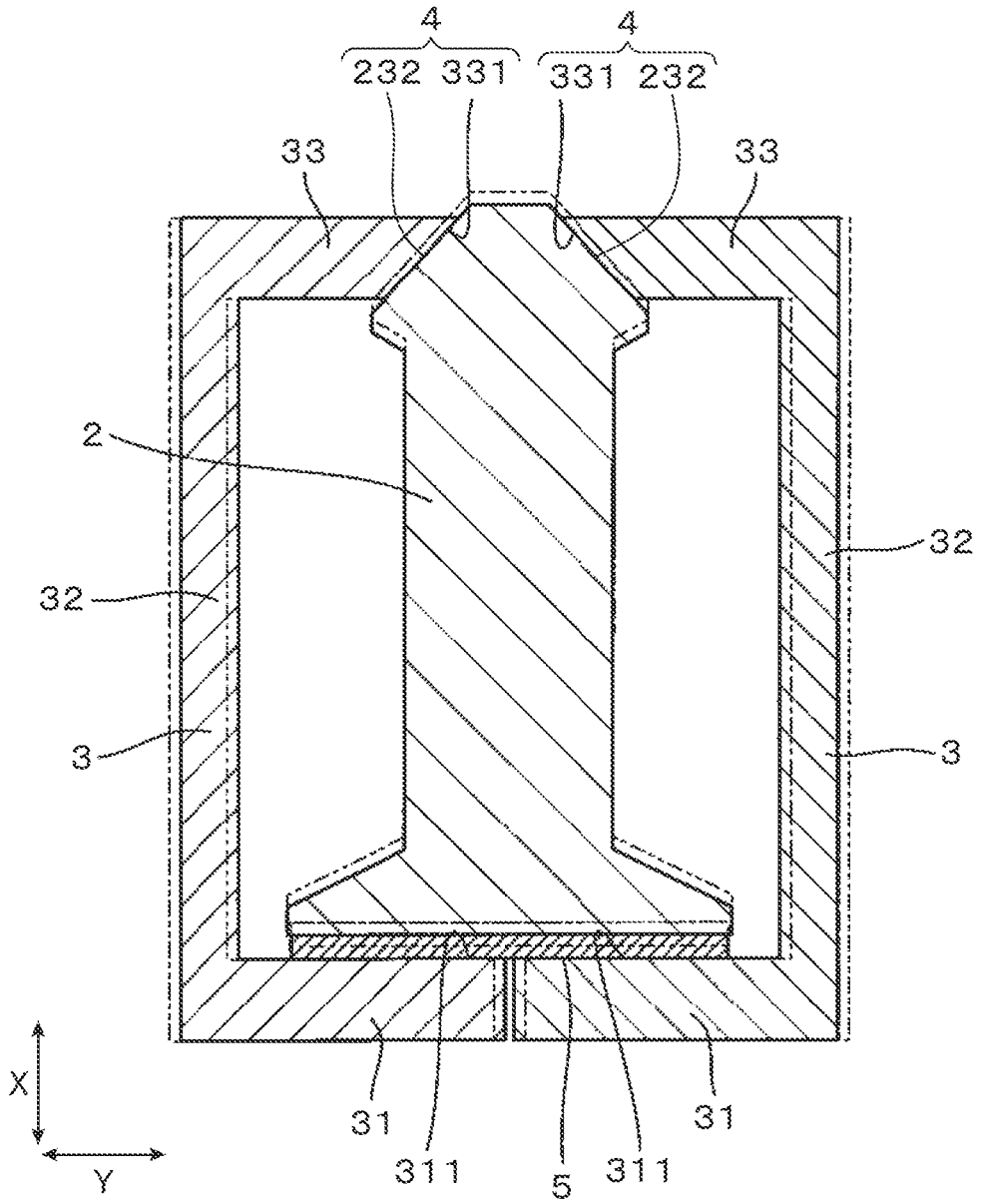
FIG. 6 is a vertical cross-sectional view illustrating the ignition coil in a condition where the central core, a magnet (e.g., magnet plate) and the pair of split cores are mutually positioned during assembly of the ignition coil according the first embodiment of the present disclosure.

Subsequently, as shown in FIGS. 4 to 6, the left and right split core chucks 8 respectively attach the pair of split cores 3 to the connector module 6 in the y-direction at both left and right sides thereof. At this moment, as shown in FIGS. 4 and 5, the first sides 31 of the split cores 3 are inserted into a gap between the magnet 5 and the igniter 14 in the arrangement recess 60 from both sides of the connector module 6, thereby mutually approximating the split cores 3 each other with respect to the connector module 6 in the y-direction. At the same time, as shown in FIG. 5, the second opposing surfaces 331 of the third sides 33 of the split cores 3 are brought in contact with corresponding rear tapered surfaces 232 opposed to each other in the rear end 23 of the central core 2 from both sides of the central core 2, respectively. In such a situation, however, a gap can be sometimes formed between the first opposing faces 311 of the first sides 31 of the split cores 3 and the magnet 5 in the x-direction.

In such a state, however, as shown in FIGS. 5 and 6, the left and right split core chucks 8 further press the split cores 3 respectively to cause the split cores 3 to mutually approach each other in the y-direction. With this, the rear tapered surfaces 232 and the second opposing surfaces 331 respectively slide on each other, and the connector module 6 including the central core 2 and the magnet 5 is integrally moved forward (i.e., downward in the drawing) with respect to the pair of split cores 3 while the pair of split cores 3 approaches each other in the y-direction. With this, as shown in FIG. 6, the magnet 5 approaches the first sides 31 of the split cores 3 and ultimately contacts the first opposing faces 311 of the first sides 31 of the split cores 3. Hence, as described heretofore, the pair of split cores 3 is positioned relative to the connector module 6.

After that, the left and right split core chucks 8 return to original positions thereof.

Next, a modification of the above-described embodiment described with reference to FIGS. 4 to 6 will be herein below described with reference to FIG. 7.

Specifically, as described with reference to FIGS. 4 to 6, the connector module 6 of the above-described embodiment is movably supported up and down (i.e., vertically) in the drawing relative to the pair of split cores 3.

By contrast, however, according to the modification, the connector module 6 is fixed to the chuck 9 which is directly fixed to the base 100 of the assembly system and is thus stable. Instead, the pair of split cores 3 of the modification is movably held up and down (i.e., vertically) in the drawing relative to the connector module 6. Specifically, a pair of left and right split core guides 99 is disposed to respectively guide the pair of split cores 3 held by the split core chucks 8 to both sides of the central core 2 in opposite y-directions.

Figure 7:
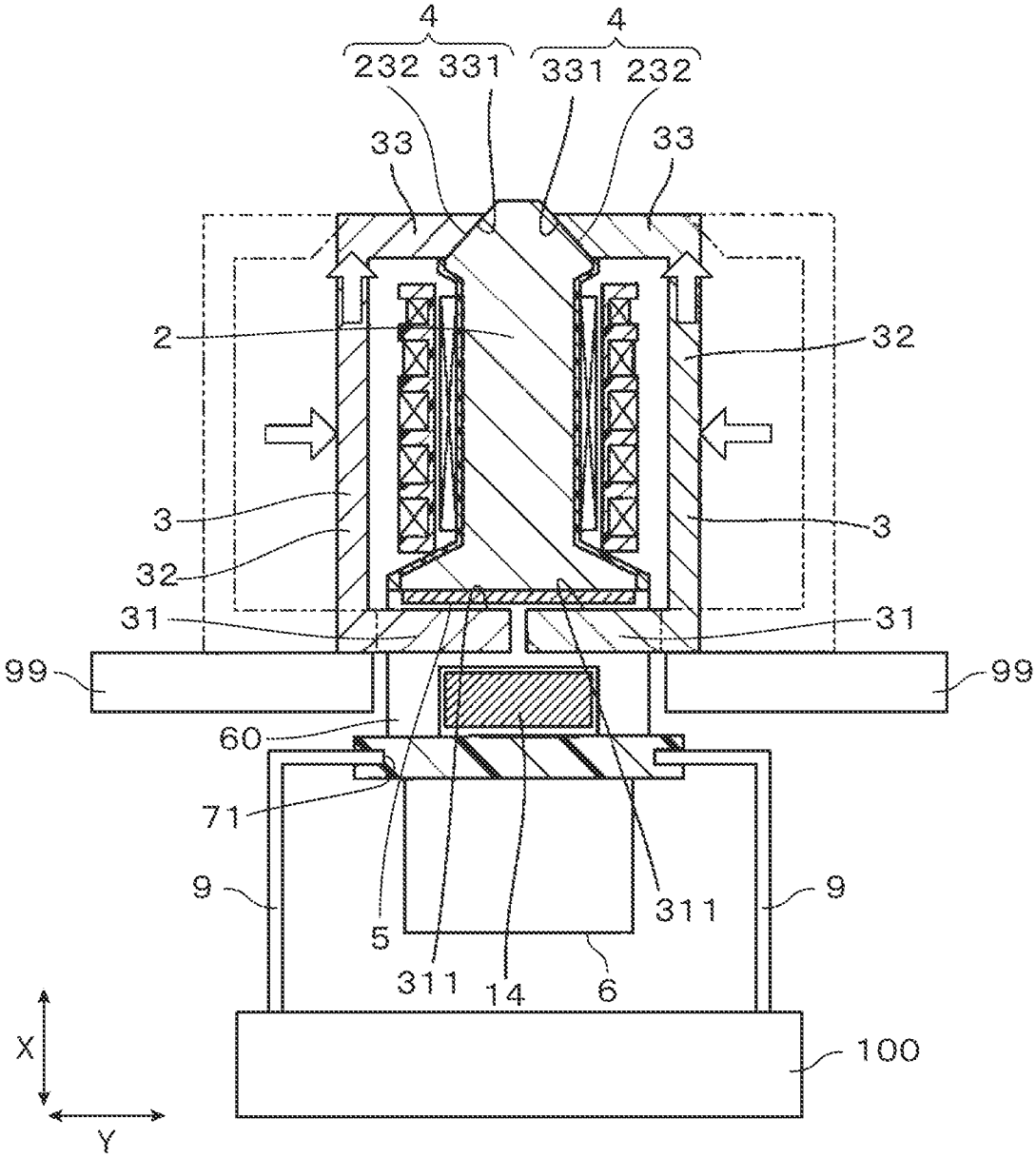
FIG. 7 is a vertical cross-sectional view illustrating another assembly system of assembling an ignition coil by bringing a pair of split cores in contact with a fixed central core and sliding second opposing faces of the pair of split cores on rear tapered surfaces of the fixed central core according a modification of the first embodiment of the present disclosure.

Hence, as shown in FIG. 7, when the left and right split core chucks 8 holding the pair of split cores 3 approach the both sides of the connector module 6 in the opposite y-directions to each other along the left and right split core guides 99 and the first sides 31 of the split cores 3 are inserted into the gap between the magnet 5 and the igniter 14 while the second opposing surfaces 331 of the third sides 33 of the split cores 3 are brought in contact with and further pressed against corresponding rear tapered surfaces 232 of the central core 2, respectively, since the connector chuck 9 stationally holds the connector module 6 via the fitting recess 71, the pair of split cores 3 respectively slide on the rear tapered surfaces 232 and moves rearward (i.e., upward in the drawing) with respect to the central core 2 until the first opposing faces 311 of the first sides 31 of the split cores 3 ultimately contact the magnet 5 as shown.

Hence, as described heretofore, the pair of split cores 3 and the connector module 6 are mutually positioned with respect to each other.

Next, an exemplary advantage of this embodiment of the present disclosure will be described herein below. In this embodiment, the first opposing faces 311 are formed in the ignition coil 1 parallel to the plane orthogonal to the x-direction. Further, the second opposing face 331 and the rear tapered surface 232 collectively constituting the pair of oblique surfaces 4 is oblique to increasingly approach the other second opposing face 331 and the rear tapered surface 232 in the y-direction collectively constituting the other pair of oblique surfaces 4. Hence, when the central core 2 and the pair of split cores 3 are assembled, by pressing the pair of split cores 3 from both sides of the central core 2 with the second opposing surfaces 331 of the pair of split cores 3 respectively contacting the rear tapered surfaces 232 of the central core 2 toward the rear tapered surfaces 232 of the central core 2 in the y-direction as described earlier, and thereby sliding the central core 2 and the pair of split cores 3 on each other on the pair of oblique surfaces 4, the central core 2 and the pair of split cores 3 can be positioned relative to each other in both the x-direction and the y-direction. That is, simply by pressing the pair of split cores 3 from both sides of the central core 2 in a single direction (i.e., y-direction), positioning between the central core 2 and the pair of split cores 3 can be achieved at once in two-directions (i.e., x-direction and y-direction). As a result, since positioning between the central core 2 and the pair of split cores 3 can be facilitated, productivity of the ignition coil 1 can also be enhanced. At the same time, by pressing the pair of split cores 3 until the magnet 5 contacts the pair of split cores 3 as described above, generation of a gap between the first opposing face 311 of the split core 3 and the magnet 5 in the x-direction, and a gap between the second opposing face 331 of the split core 3 and the rear tapered surface 232 of the central core 2 can be prevented.

Further, each of the second opposing surfaces 331 acting as the pair constitutes the pair of left and right oblique surfaces 4 as described earlier. That is, the pair of oblique surfaces 4 is formed at each of two left and right sides of the rear end 23 of the central core 2 in the y-direction, respectively. Hence, by assembling the pair of split cores 3 and the central core 2 together while sliding these on each other in each of the pairs of oblique surfaces 4 as described above, generation of gaps between the split cores 3 and the magnet 5 in the x-direction, and gaps between the split cores 3 and the rear tapered surfaces 232 of the central core 2 can be prevented.

Further, the central core 2 has the connection surface 233 connecting rear edges of the rear tapered surfaces 232 with each other in the y-direction. With this, the rear tapered surfaces 232 are separated from each other in the y-direction. Hence, when the central core 2 and the pair of split cores 3 are assembled while sliding these devices on each other on each of the pairs of oblique surfaces 4 as described earlier, since the pair of split cores 3 do not contact each other during such sliding operation, the sliding operation can be prevented from being interfered by the contact.

Here, the rear tapered surface 232 and the second opposing face 331 can deviate from each other when viewed from the z-direction due to either assembling tolerance caused when the central core 2 and the pair of split cores 3 are assembled or dimensional tolerances of these parts. As a result, an effective area of a cross-section of the magnetic path formed by the central core 2 and the pair of split cores 3 is accordingly reduced.

In view of this, according to the above-described embodiment, the wider surface 41 (i.e., one of the second opposing face 331 and the rear tapered surface 232 constituting the pair of oblique surfaces 4 has a greater width in the inclination direction in the pair of oblique surfaces 4 wider than a width of the narrower surface 42 as the other one of these surfaces 331 and 232. In addition to this, the narrower surface 42 is disposed within the wider surface 41 in the inclination direction. Hence, by widening one of the oblique surfaces 4 to obtain the wider surface 41, the narrower surface 42 is highly likely positioned within the wider surface 41 even if the central core 2 and the pair of split cores 3 are slightly misaligned when viewed in the z-direction. Hence, since at least an area of the narrower surface 42 can be ensured as the magnetic path area, an effective cross-sectional area of the magnetic path can effectively be maintained.

Further, the wider surfaces 41 are formed on the central core 2. In addition to this, the rear flange portions 231 project in the y-direction from both sides of the rear end of the central core 2 located further from the first opposing faces 311 in the x-direction, and portions of the surfaces of the rear flange portions 231 constitute the wider surfaces 41, respectively. Hence, by forming the rear flange portions 231 in this way, the rear tapered surfaces 232 of the central core 2 acting as the wider surfaces 41 can be easily widened than the second opposing surfaces 331 of the split cores 3 acting as the narrower surfaces 42. Further, in general, the magnetic flux Φ is formed through a shortest annular closed path along the central core 2 and the pair of split cores 3. However, by forming the rear flange portions 231 at the rear end 23 of the central core 2, Such an annular closed magnetic path along the central core 2 and the pair of split cores 3 can be effectively shortened.

Here, as described earlier with reference to FIG. 1, since the magnetic fluxes Φ flow through the shortest paths formed along the central core 2 and the pair of split cores 3, respectively, the magnetic fluxes Φ easily flow between the front end 21 of the central core 2 and the pair of split cores 3 through left and right ends of the front end 21 of the central core 2 in the y-direction. By contrast, the magnetic fluxes Φ flow less easily between the front end 21 of the central core 2 and the pair of split cores 3 through the central region of the core front end face 211 in the y-direction. However, according to one embodiment of the present disclosure, the left and right split cores 3 (i.e., the pair of split cores 3) have laterally opposing faces 312 laterally facing each other in the y-direction in front of the central core 2, and the laterally opposing faces 312 are positioned at the central region of the end face of the central core 2 in the vertical direction. Hence, even if the pair of laterally opposing faces 312 separated from each other in the central region of the core front end face 211 in the y-direction, thereby forming a space therebetween, performance of the ignition coil 1 can be maintained due to positioning of the laterally opposing faces 312 at the central region of the end face of the central core 2.

As described heretofore, according to this embodiment of the present disclosure, productivity of the ignition coil can be enhanced.

Figure 8:
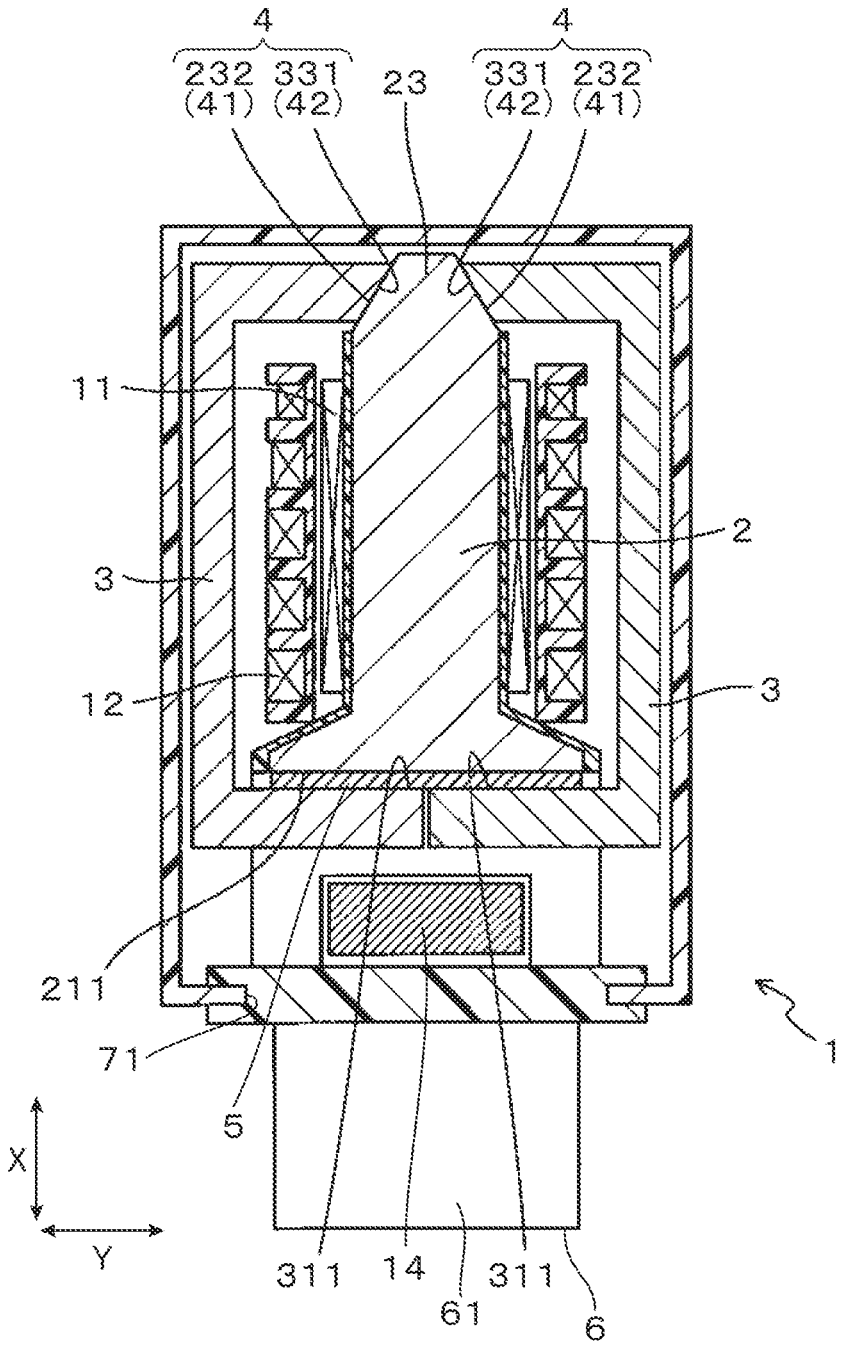
FIG. 8 is a vertical cross-sectional view illustrating another exemplary ignition coil according to a second embodiment of the present disclosure.

Now, a second embodiment of the present disclosure is herein below described with reference to FIG. 8. Further, like reference numerals and marks as used in the above-described first embodiment herein below designate identical parts in the following embodiments. As shown in FIG. 8, a shape of the rear end 23 of the central core 2 of the first embodiment is modified in this embodiment. That is, the rear flange portion 231 employed in the first embodiment as shown in FIG. 1 is omitted in this embodiment. Instead of this, a degree of angle formed between the second opposing face 331 and an axis extended in the x-direction is less than 45 degrees. Similarly, a degree of angle formed between the rear tapered surface 232 and the axis extended in the x-direction is less than 45 degrees. Also, in this embodiment, the rear tapered surface 232 and the second opposing face 331 collectively constitute a pair of oblique surfaces 4.

Remaining members and parts employed in this embodiment are substantially the same as employed in the first embodiment of the present disclosure.

Hence, substantially the same advantage as obtained in the first embodiment can be similarly obtained in this embodiment of the present disclosure.

Figure 9:
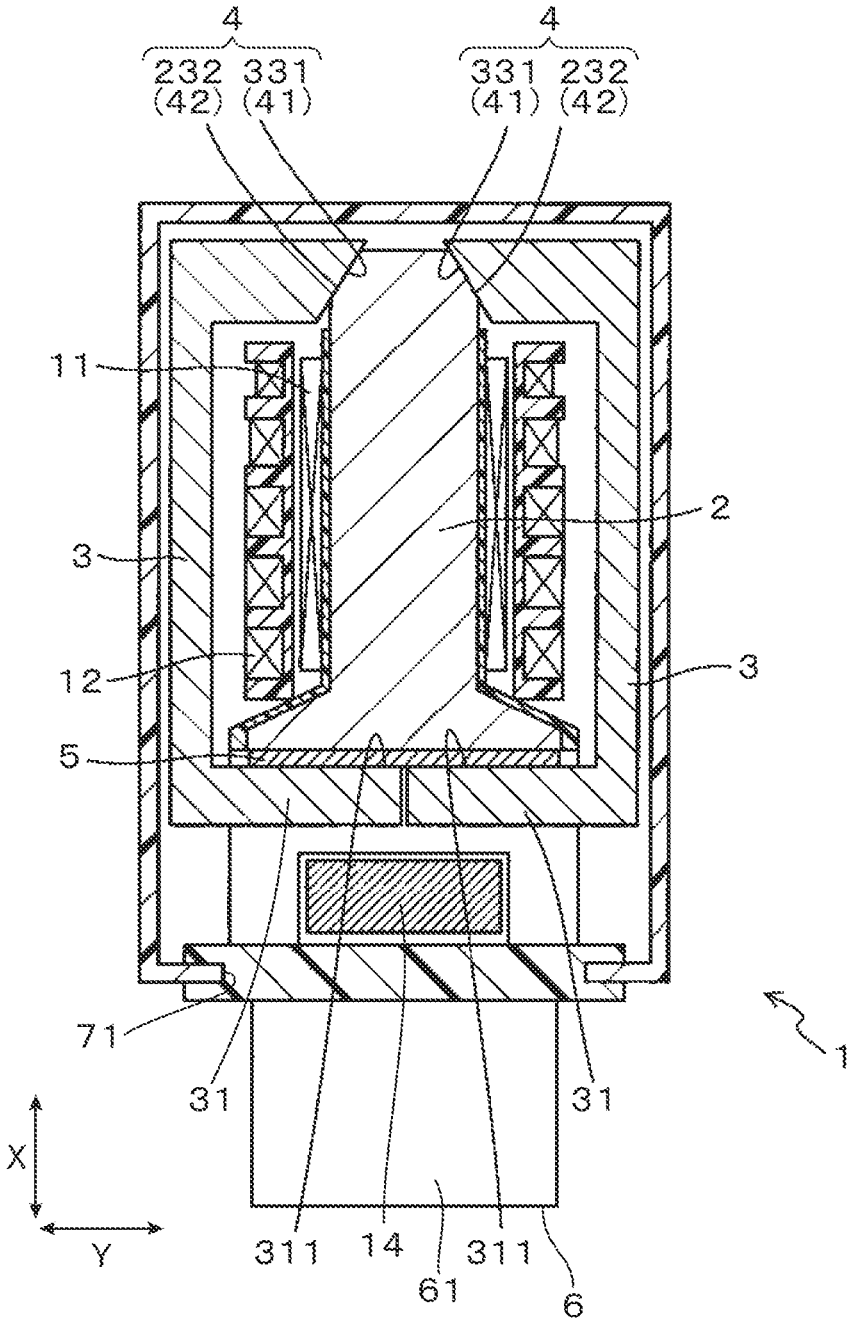
FIG. 9 is a vertical cross-sectional view illustrating yet another exemplary ignition coil according to a third embodiment of the present disclosure.

Now, a third embodiment of the present disclosure is herein below described with reference to FIG. 9. As shown in FIG. 9, different from the second embodiment 2, among the pair of oblique surfaces 4, wider surfaces 41 are symmetrically formed in the left and right split cores 3, respectively, and narrower surfaces 42 are formed in the central core 2 in this embodiment. Further, the third sides 33 of the left and right split cores 3 are thicker than the first sides 31 of the left and right split cores 3 in the x-direction. In addition to this, in an inclination direction of the pair of oblique surfaces 4, the rear tapered surfaces 232 are positioned within the respective second opposing surfaces 331. Remaining members and parts employed in this embodiment are substantially the same as employed in the second embodiment of the present disclosure.

Hence, substantially the same advantages as obtained in the second embodiment can be similarly obtained in this embodiment of the present disclosure.

The present disclosure is not limited to the above-described embodiments, and includes various modifications which do not deviate from a gist of the present disclosure. For example, in the above-described embodiments, the pairs of oblique surfaces are respectively formed on both sides of the rear end of the central core 2 facing to the lateral direction orthogonal to the coil axial direction. However, only one pair of oblique surfaces may be employed at one side of the rear end of the central core 2 facing to the lateral direction. That is, the second opposing face of the split core 3 and a surface of the central core 2 facing the second opposing face can have planar shapes orthogonally extended to the lateral direction. Again, as in the first embodiment, by performing assembly by substantially sandwiching the rear end of the central core with the second opposing faces of the pair of split cores, respectively, positioning between the central core and the pair of split cores can be achieved both in the coil axial direction and the lateral direction. Specifically, in such a situation, when the split cores 3 with the pair of oblique surfaces are laterally pressed from both sides of the central core against the rear tapered surface of the central core, respectively, the pair of split cores 3 laterally approach each other, and the central core 2 is moved forward at the same time. At this moment, one of the split cores 3 not constituting the pair of oblique surfaces 4 acts as a support when the other one of split cores constituting the pair of oblique surfaces 4 is laterally pressed against the rear tapered surface of the central core 2 as described earlier. At the same time, the central core portion relatively slides on the second opposing face of the split core 2 not constituting the pair of oblique surfaces 4 in the coil axial direction.

Further, in the above-described embodiments, the second opposing face and the surface portion of the central core collectively constituting the pair of oblique surfaces 4 are linearly tapered when viewed in the z-direction. However, the present disclosure is not limited to such a tapered shape, and can employ a slightly curved surface for each of the pair of oblique surfaces 4. In such a situation, however, since sliding performance can be reduced if each of the pair of oblique surfaces sharply curves, a degree of curvature of the curved surface is preferably low.

As described heretofore with reference to various drawings, reference numeral 1 represents the ignition coil. Reference numeral 11 represents the primary coil. Reference numeral 12 represents the secondary coil. Further, reference numeral 2 represents the central core. Reference numeral 211 represents the front face of the central core. Reference numeral 3 represents the split core. Furthermore, reference numeral 311 represents the first opposing face. Reference numeral 331 represents the second opposing face. Reference numeral 4 represents the pair of oblique surfaces.

Numerous additional modifications and variations of the present disclosure are possible in light of the above teachings. It is therefore to be understood that within the scope of the appended claims, the present disclosure may be performed otherwise than as specifically described herein. For example, the present disclosure is not limited to the above-described ignition coil and may be altered as appropriate.

What is claimed is:

1. An ignition coil comprising:

a primary coil;

a secondary coil magnetically coupled to the primary coil, the secondary coil coaxially wound radially outside of the primary coil;

a central core disposed radially inside of the primary coil with both ends projecting from both of the primary coil and the secondary coil in a coil axial direction, the central core having:

a central core front end face at a front end thereof facing forward in the coil axial direction, and a pair of central core rear end oblique surfaces at a rear end thereof, the pair of central core rear end oblique surfaces being symmetrically inclined with a central axis of the central core; and a pair of split cores surrounding the primary coil and the secondary coil together with the central core, the pair of split cores respectively facing outer peripheral portions of the secondary coil in an orthogonal direction orthogonal to the coil axial direction, the pair of split cores respectively forming two closed magnetic paths with the central core, at least one of the pair of the split cores having a first opposing face to face the central core front end face and partially form the closed magnetic path, the first opposing face orthogonally extended to the coil axial direction, the pair of split cores respectively having two second oblique opposing surfaces which are symmetric with the central axis of the central core when attached thereto, the pair of split cores mutually facing each other in the orthogonal direction while contacting the central core rear end oblique surfaces, wherein at least one of the second oblique opposing surfaces and the central core rear end oblique surface contacting the at least one of second oblique opposing surfaces are inclined at substantially the same degree of angle from the central axis of the central core and increasingly approach the other one of the central core rear end surfaces in the orthogonal direction in proportion to a distance of a portion of each of the at least one of the second oblique opposing surfaces and the central core rear end oblique surface from the first opposing face of the at least one of the pair of the split cores in the coil axial direction.

2. The ignition coil as claimed in claim 1, wherein the second oblique opposing surfaces respectively contact the central core rear end oblique surfaces opposed to the second oblique opposing surfaces.

3. The ignition coil as claimed in claim 2, wherein the central core has a connection surface (233) to connect rear edges of the rear end oblique surfaces with each other along the orthogonal direction at a side of the rear end surfaces that is furthest from the first opposing face in the coil axial direction.

4. The ignition coil as claimed in claim 1, wherein one of the central core rear end oblique surface and the second oblique opposing surface contacting the central core rear end oblique surface has a wider surface along an inclination direction in which the central core rear end oblique surface and the second oblique opposing surface are inclined, and the other one of the central core rear end oblique surface and the second oblique opposing surface contacting the central core rear end oblique surface has a narrower surface narrower than the wider surface along the inclination direction, wherein the narrower surface is positioned within the wider surface in the inclination direction.

5. The ignition coil as claimed in claim 4, wherein the central core has a pair of symmetric protrusions at a rear end thereof furthest from the first opposing face in the coil axial direction, the pair of protrusions oppositely projecting in the orthogonal direction, respectively, wherein at least a portion of each of the protrusions forms the wider surface.

6. The ignition coil as claimed in claim 1, wherein the pair of the split cores respectively have orthogonally opposing faces facing each other in the orthogonal direction, the orthogonally opposing faces located beside a middle of the central core front end face extended in the orthogonal direction orthogonal to the coil axial direction.

7. The ignition coil as claimed in claim 1, further comprising a magnetic plate to enhance an output voltage output from the ignition coil, the magnetic plate being attached to the central core front end face between the central core front end face and the first opposing face of one of the pair of split cores, wherein the central core, the magnet plate and the pair of split cores are mutually positioned during assembly of the ignition coil by pressure contacting and further pressing the pair of split cores against the central core in the orthogonal direction while sliding the at least one of the second oblique opposing surfaces and the central core rear end oblique surface on each other until the central core front end face contacts the first opposing face via the magnet plate.

* * * * *